United States Patent [19]

Beasley

[11] Patent Number: 4,458,635

[45] Date of Patent: Jul. 10, 1984

[54] TWO-CYCLE INTERNAL COMBUSTION ENGINE

[76] Inventor: Albert W. Beasley, 2127 W. Sheridan, Oklahoma City, Okla. 73107

[21] Appl. No.: 422,427

[22] Filed: Sep. 23, 1982

[51] Int. Cl.[3] ..... F02B 33/00; F02B 75/12

[52] U.S. Cl. ..... 123/68; 60/39.6; 123/39

[58] Field of Search ..... 123/68, 39; 60/39.6

[56] References Cited

U.S. PATENT DOCUMENTS

| | | | |
|---|---|---|---|
| 708,236 | 9/1902 | Leonard | 60/39.6 |
| 1,062,999 | 5/1913 | Webb | 60/39.6 |
| 1,746,728 | 2/1930 | Ensign | 123/68 |

FOREIGN PATENT DOCUMENTS

| | | | |
|---|---|---|---|
| 678108 | 12/1929 | France | 60/39.6 |
| 2319769 | 2/1977 | France | 60/39.6 |
| 16157 | of 1895 | United Kingdom | 60/39.6 |

*Primary Examiner*—Wendell E. Burns
*Attorney, Agent, or Firm*—Robert K. Rhea

[57] ABSTRACT

In a valve in head two-cycle internal combustion engine, a slave piston and a power piston reciprocate in a pair of parallel cylinders. Valve opened and closed intake and exhaust ports respectively communicate with the slave piston and power piston cylinders. The engine head centrally contains a combustion chamber overlying a portion of both cylinders and communicating therewith through a valve opened and closed combustion inlet port and a combustion outlet port, respectively communicating with the slave cylinder and power cylinder so that a fuel rich mixture, when ignited in the combustion chamber, mixes with and burns air compressed in the power cylinder. An engine head supported rocker arm and shaft assembly, driven by a cam shaft, opens and closes the valves in sequence with the reciprocating pistons.

2 Claims, 5 Drawing Figures

TWO-CYCLE INTERNAL COMBUSTION ENGINE

BACKGROUND OF THE INVENTION

1. Field of the Invention

The present invention relates to a valve in head two-cycle internal combustion engine having a slave cylinder compressing a fuel rich mixture in an engine head combustion chamber communicating with the power cylinder through a valve controlled opening.

2. Description of the Prior Art

I do not know of any patents disclosing an engine according to this invention.

SUMMARY OF THE INVENTION

An engine block defines a pair of parallel cylinders, each having a piston ring equipped piston slidably mounted therein and connected with a crankshaft by a piston rod. One of the pistons acts as a slave piston and the other forms a power piston. An engine head overlies the engine block and is provided with fuel mixture intake and exhaust ports. An intake valve provides communication between the fuel mixture intake port and the slave piston. Similarly, the exhaust port communicates with the power piston through an exhaust valve closed opening. A central portion of the head is provided with a chamber defining a fuel mixture compression chamber communicating with pistons through head openings above the slave piston and power piston. A third valve provides and interrupts communication between the slave piston cylinder and the compression chamber. Similarly, a fourth valve provides and interrupts communication between the compression chamber and the power piston cylinder. The several valves being operated by a cam shaft driven rocker arm and shaft assembly. At least one spark plug, supported by the engine head, ignites the compressed fuel mixture.

The principal object of this invention is to provide a two-cycle internal combustion engine having a slave piston compressing a fuel rich mixture in an engine head contained combustion chamber communicating with a companion piston equipped power cylinder through a valve opened and closed opening in which the power piston compresses air to be mixed with and burn with the fuel rich mixture, thus efficiently utilizing all the fuel mixture.

DESCRIPTION OF THE PREFERRED EMBODIMENT

Figure 1:
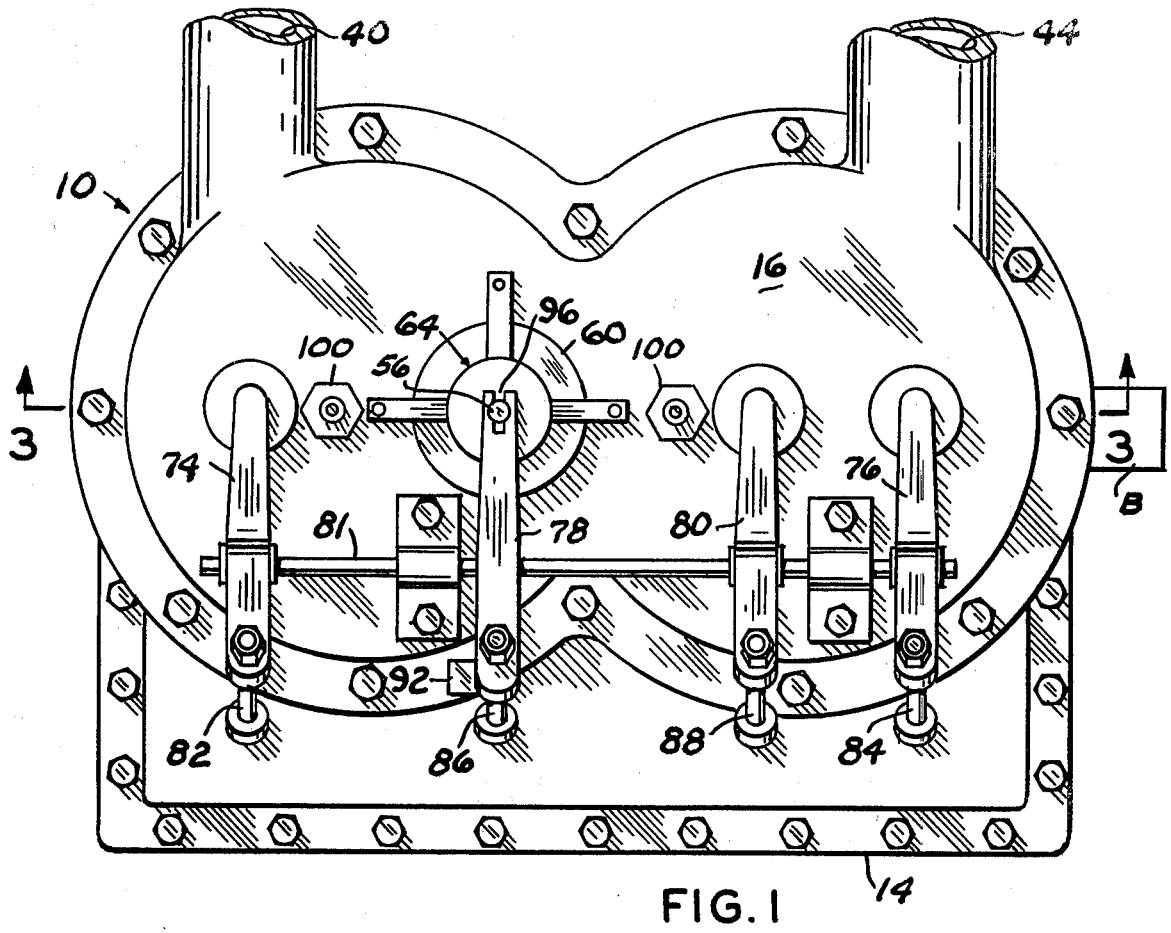
FIG. 1 is a top view of the engine.

Like characters of reference designate like parts in those figures of the drawings in which they occur.

In the drawings:

The reference numeral 10 indicates the engine, as a whole, comprising an engine block 12 having an oil containing crankcase 14 and an overlying engine head 16. The engine block 12 defines a pair of parallel cylinders 18 and 20, respectively containing a piston ring equipped slave piston 22 and a piston ring equipped power piston 24, each connected in a conventional manner by piston rods 26 and 28 with a crankshaft 30 journalled by the block 12 and having a flywheel 32 secured to one of its ends. The crankshaft 30 positions the slave piston 22 slightly ahead of the power piston 24 so that the slave piston 22 reaches top-dead-center to complete its compression stroke before the power piston reaches top-dead-center. The engine block is characterized by a double wall defining an engine coolant compartment 34 supplied with water, or the like, from a pump, not shown. The engine block is further provided with a plurality of lateral openings 36, only one being shown, in its wall defining the power cylinder 20 and positioned at the lower limit of movement of the power piston for exhausting burned fuel by a blower B, as presently explained.

The engine head 16 is provided with a fuel mixture inlet chamber 38, overlying a portion of the slave piston cylinder 18, for communication therewith through a valve seat 39 and communicating with a fuel mixture inlet port 40 supplied by a carburetor, or the like, not shown. The head 16 is also provided with an exhaust chamber 42 overlying and communicating with the power piston cylinder 20 through a valve seat 43 and communicating with an exhaust port 44. The central portion of the head 16 is provided with a fuel compression chamber 45 overlying and communicating with both the slave piston cylinder 18 and power piston cylinder 20 through valve seats 46 and 47. A spring urged intake valve 48 is normally seated on the slave cylinder fuel intake valve seat 39 and an exhaust valve 52 normally closes the exhaust chamber valve seat 43. A spring urged third compression chamber inlet valve 56 is normally seated on the compression chamber inlet valve seat 46. The compression chamber inlet valve 56 is a downwardly seating valve supported for vertical reciprocation by a valve guide 60 having a valve stem sealing O'ring 61 and removably received threadedly by the engine head for easily replacing this valve. The valve 56 is normally maintained in its seated position by a spring 62 surrounding the valve stem and bearing at one end against a cage 64 secured to the engine head around the valve guide 60 with the other end of the spring 62 bearing against a spring keeper 63 secured to the valve stem adjacent the valve guide 60. A fourth valve, forming a spring urged combustion release valve 66, is normally seated on the combustion chamber outlet valve seat 43 with its stem slidably received by a valve guide 70 mounted on the engine head and having a valve stem sealing O'ring 71. The power piston 24 is characterized by a recess 72 in its compression end loosely surrounding the head of the valve 66, when the latter is opened, for the purposes presently explained.

Figure 2:
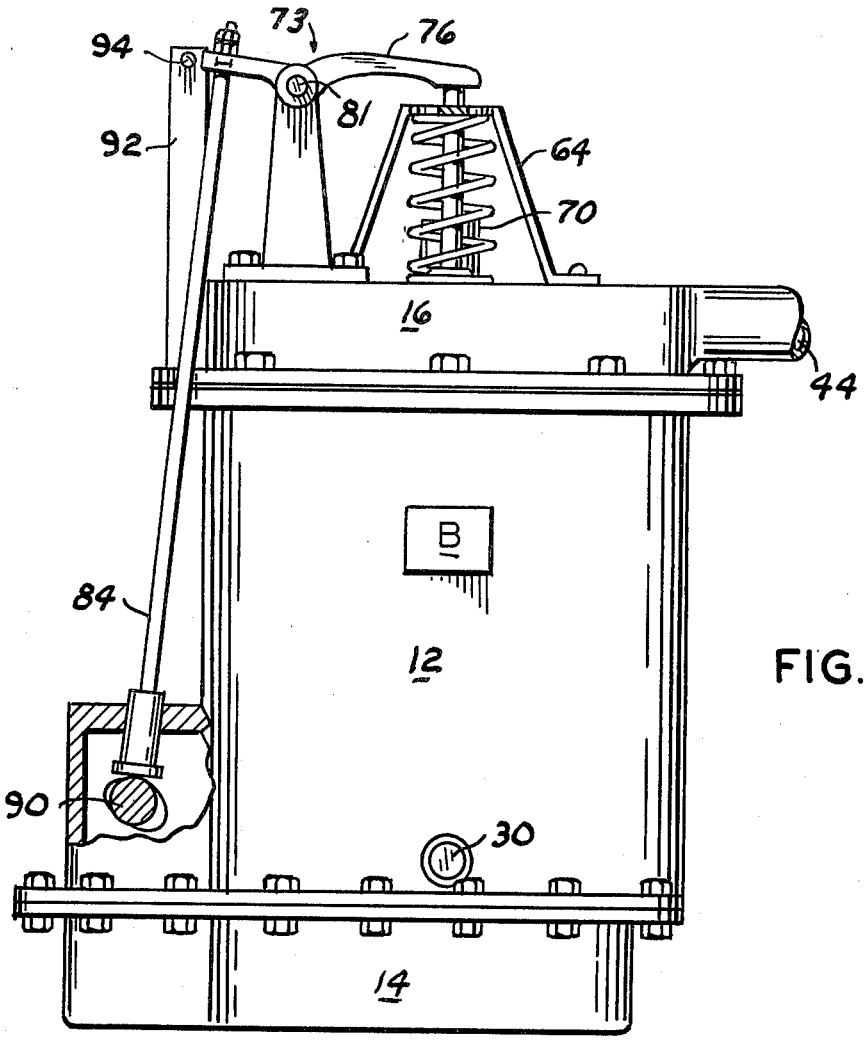
FIG. 2 is a right side elevational view, partially in section, of FIG. 1.

The engine head further includes a substantially conventional rocker arm and shaft assembly means 73 supported by the head and including an inlet valve rocker arm 74, an exhaust valve rocker arm 76, a combustion chamber inlet valve rocker arm 78 and a combustion chamber outlet valve rocker arm 80. The rocker arms 74, 76 and 80 are pivotally mounted intermediate their ends on a shaft 81. The several rocker arms are vertically reciprocated in a predetermined sequence by push rods 82, 84, 86 and 88 by an engine driven cam shaft 90 (FIG. 2).

The compression chamber inlet valve rocker arm 78 is pivotally mounted at one end on the upper end of an engine head supported standard 92 by a pin 94 (FIG. 2) with the other end of the rocker arm 78 bifurcated, as at 96, for slidably engaging a slot 98 in the upper end of the valve stem 56 for lifting the valve 56 to an open position against the force of its spring 62 in a predetermined sequence, as presently explained. The push rod 86 engages the depending surface of the rocker arm 78 adjacent the standard 92 to perform this function.

The engine head 16 is further provided with at least one, preferably two, spark plugs 100 communicating with the combustion chamber 45 and fired simultaneously by a distributor, not shown, in sequence with the valve and piston operation, as more fully explained hereinbelow.

OPERATION

Figure 4:
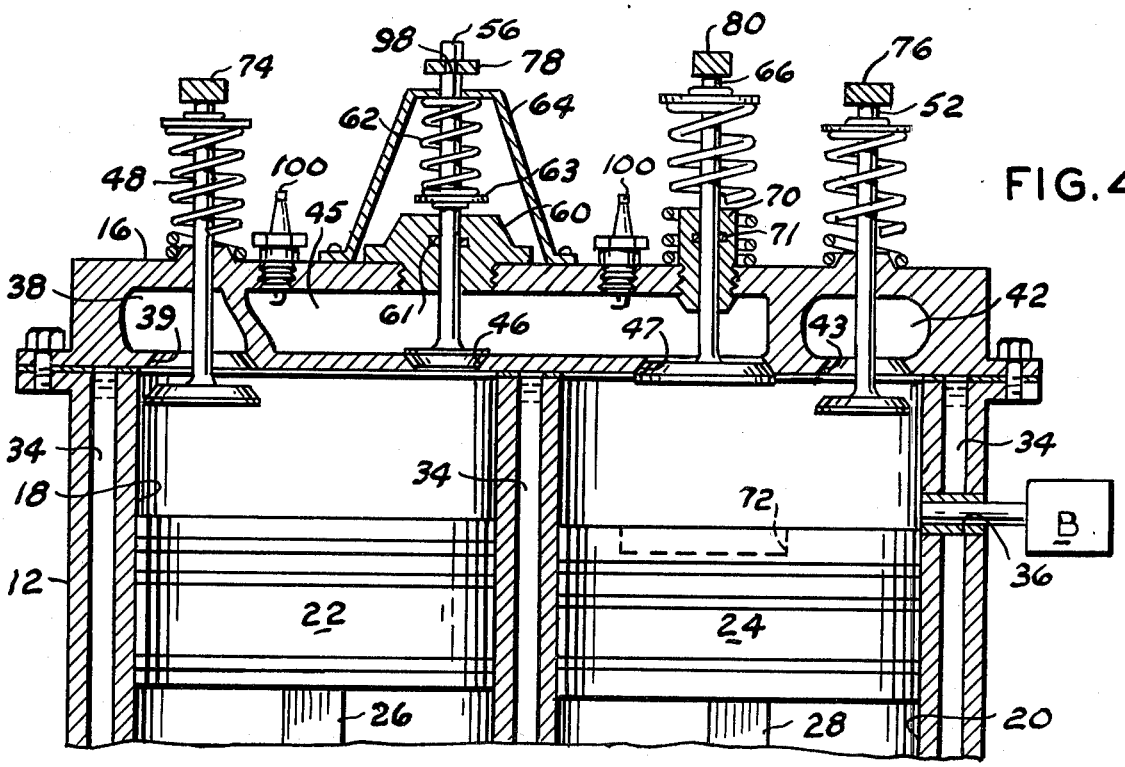
FIG. 4 is a fragmentary vertical cross sectional view similar to FIG. 3 illustrating the piston and valve positions at the downward limit of the power stroke; and, FIG. 5 is a view similar to FIG. 4 illustrating the pistons and valve positions near the upper limit of the compression stroke.
Figure 3:
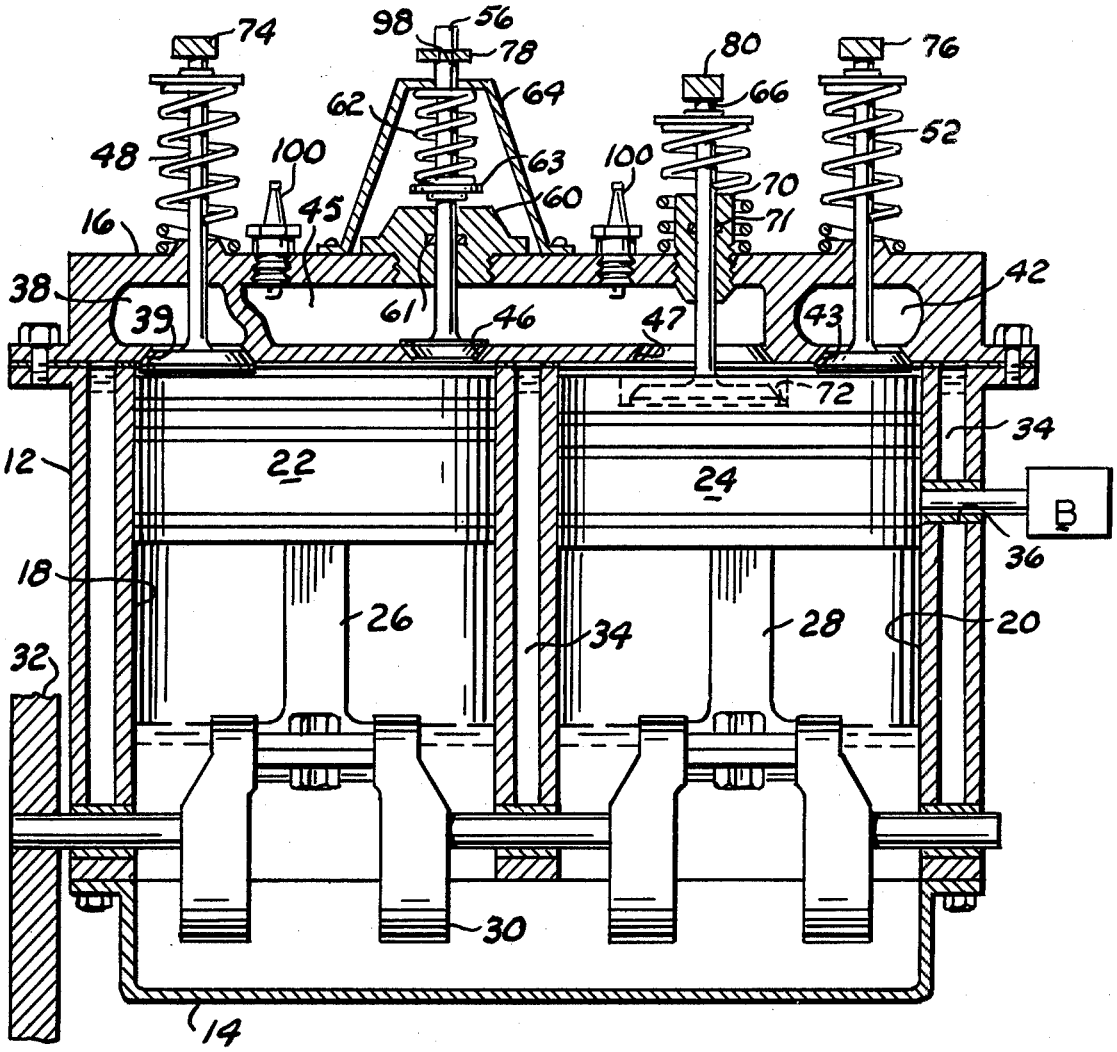
FIG. 3 is a fragmentary vertical cross sectional view taken substantially along the line 3—3 of FIG. 1 illustrating the piston and valve positions at the moment of combustion.

In operation, FIG. 3 illustrates the position of the valves and pistons at the upper limit of the compression stroke in which the intake and exhaust valves 48 and 52 and the compression chamber valve 56 are closed at the moment of ignition of a fuel rich mixture in the compression chamber 45. The compression outlet valve 66 being open and nested by the power piston recess 72. The fuel burning in the compression chamber 45 enters the power cylinder 20 above the power piston 24 through the valve seat 47 wherein oxygen compressed by the power piston mixes with and burns thus forcing both pistons downwardly in a power stroke to the limit of their travel, illustrated by FIG. 4. As the slave piston 22 moves downwardly, the intake valve 48 is opened to admit fuel rich mixture into the slave cylinder 18 above the upper end of the slave piston. When the pistons have reached the limit of their downward movement (FIG. 4), the compression chamber outlet valve 66 is closed and the exhaust valve 52 is opened so that air under pressure from the blower B exhausts burned gases through the exhaust port 44.

Figure 5:
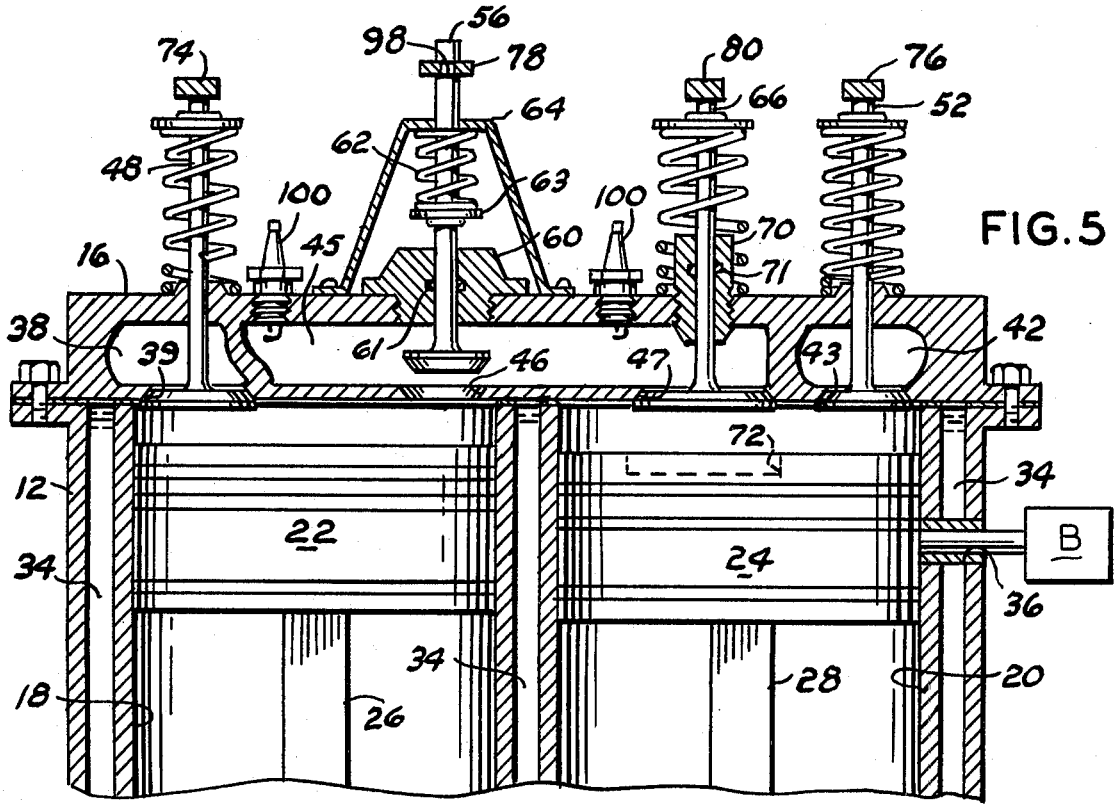

As illustrated by FIG. 5, as the pistons move upwardly, the intake valve 48, exhaust valve 52 and compression chamber outlet valve 66 are closed while the combustion chamber inlet valve 56 is open so that fuel mixture in the slave cylinder is compressed in the combustion chamber 45 by the slave piston 22 while simultaneously, air within the power cylinder 20 is compressed by the power piston 24 until the slave piston 22 reaches top-dead-center and the compression chamber inlet valve 56 closes. The compression chamber outlet valve 66 opens when the power piston 24 reaches top-dead-center which completes one cycle of operation.

Obviously the invention is susceptible to changes or alterations without defeating its practicability. Therefore, I do not wish to be confined to the preferred embodiment shown in the drawings and described herein.

I claim:

1. A two-cycle internal combustion engine, comprising:

an engine block having a crankcase and defining a slave cylinder and power cylinder parallel with the slave cylinder;

a crankshaft journalled by the engine block;

a slave piston within the slave cylinder;

a power piston within the power cylinder;

connecting rods connecting said pistons with said crankshaft for reciprocating said pistons in substantial unison, said slave piston and said power piston being mounted on said crankshaft in a manner to dispose said slave piston at top-dead-center before said power piston reaches top-dead-center;

an engine head overlying said engine block, said engine head having a fuel mixture intake port communicating with said slave cylinder, a burned fuel exhaust port communicating with said power cylinder and having a central recess forming a fuel mixture combustion chamber overlying at least a portion of said slave and said power cylinders and communicating therewith through a combustion chamber inlet port and a combustion chamber outlet port, respectively;

valve means supported by said engine head for opening and closing the respective port in a predetermined sequence, said valve means including a valve spring normally urging the respective valve toward a closed position, rocker arm and shaft means supported by said engine head for operating said valves; and, cam and push rod means for operating the rocker arms;

blower means connected with said power cylinder for exhausting burned fuel, said power cylinder being provided with at least one lateral port in its side wall for communication with said blower means.

2. The engine according to claim 1 in which said engine block is characterized by spaced-apart walls surrounding said slave and power cylinders for forming an engine coolant receiving chamber.

* * * * *